US009638398B2

(12) United States Patent
Nicolai et al.

(10) Patent No.: US 9,638,398 B2
(45) **Date of Patent: *May 2, 2017**

(54) LIGHTING DEVICES

(71) Applicant: Apogee Translite, Inc., Deer Park, NY (US)

(72) Inventors: Richard Nicolai, St. James, NY (US); Martin Gaon, Merrick, NY (US)

(73) Assignee: APOGEE TRANSLITE, INC., Deer Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/284,949

(22) Filed: May 22, 2014

(65) Prior Publication Data

US 2014/0254132 A1 Sep. 11, 2014

Related U.S. Application Data

(63) Continuation of application No. 13/627,411, filed on Sep. 26, 2012, now Pat. No. 8,814,376.

(51) Int. Cl.

| | |
|---|---|
| ***F21V 21/00*** | (2006.01) |
| ***F21V 1/00*** | (2006.01) |
| ***F21V 5/00*** | (2015.01) |
| ***F21V 7/00*** | (2006.01) |
| ***F21V 13/04*** | (2006.01) |
| ***F21V 9/16*** | (2006.01) |
| *F21S 9/02* | (2006.01) |
| *F21V 29/77* | (2015.01) |
| *F21Y 101/00* | (2016.01) |
| *F21Y 103/10* | (2016.01) |
| *F21Y 115/10* | (2016.01) |

(52) U.S. Cl.

CPC ..... *F21V 13/04* (2013.01); *F21V 7/005* (2013.01); *F21V 7/0008* (2013.01); *F21V 9/16* (2013.01); *F21S 9/022* (2013.01); *F21V 29/777* (2015.01); *F21Y 2101/00* (2013.01); *F21Y 2103/10* (2016.08); *F21Y 2115/10* (2016.08); *Y10T 29/49716* (2015.01)

(58) Field of Classification Search

CPC .... F21V 13/04; F21V 29/2206; F21V 7/0008; F21V 7/005; F21V 9/16; F21V 29/2237; F21Y 2103/003; F21Y 2101/02; F21S 9/022

See application file for complete search history.

(56) References Cited

U.S. PATENT DOCUMENTS

| | | | |
|---|---|---|---|
| 6,515,313 | B1 | 2/2003 | Ibbetson et al. |
| 6,600,175 | B1 | 7/2003 | Baretz et al. |
| 6,657,236 | B1 | 12/2003 | Thibeault et al. |

(Continued)

*Primary Examiner* — Donald Raleigh

(74) *Attorney, Agent, or Firm* — Tutunjian & Bitetto, P.C.

(57) ABSTRACT

A lighting device includes a cover portion configured to have a hinged connection for mounting on a housing. The cover portion includes a light emitting diode (LED) and a mixing chamber having a reflective internal surface for receiving light from the LED. A phosphorescent lens is disposed opposite the LED and is configured to reflect light from the LED back to the mixing chamber and to emanate absorbed light from the lens to a surrounding region outside of the mixing chamber. An LED driver circuit is configured to power the LED, the LED driver circuit being electrically connected to a power source. Other embodiments are also disclosed.

22 Claims, 9 Drawing Sheets

(56) References Cited

U.S. PATENT DOCUMENTS

| | | | | |
|---|---|---|---|---|
| 6,906,352 | B2 | 6/2005 | Edmond et al. | |
| 6,958,497 | B2 | 10/2005 | Emerson et al. | |
| 7,211,833 | B2 | 5/2007 | Slater, Jr. et al. | |
| 7,213,940 | B1 | 5/2007 | Van De Ven et al. | |
| 7,312,474 | B2 | 12/2007 | Emerson et al. | |
| 7,335,920 | B2 | 2/2008 | Denbaars et al. | |
| 7,446,345 | B2 | 11/2008 | Emerson et al. | |
| 7,692,182 | B2 | 4/2010 | Bergmann et al. | |
| 7,704,763 | B2 | 4/2010 | Fujii et al. | |
| 7,768,192 | B2 | 8/2010 | Van De Ven et al. | |
| 8,272,763 | B1 * | 9/2012 | Chinnam | F21V 29/004 362/147 |
| 2009/0147513 | A1 | 6/2009 | Kolodin et al. | |
| 2010/0157610 | A1 * | 6/2010 | Xiao | F21V 15/013 362/370 |
| 2012/0039067 | A1 | 2/2012 | Kim et al. | |
| 2012/0262902 | A1 | 10/2012 | Pickard et al. | |
| 2013/0051008 | A1 | 2/2013 | Shew | |

* cited by examiner 100
120
120
110
136
104
114
112
102
136
110
132
116

216
214
202
212
110
120
220
206
210
104
102
114
100
112
208
204
A

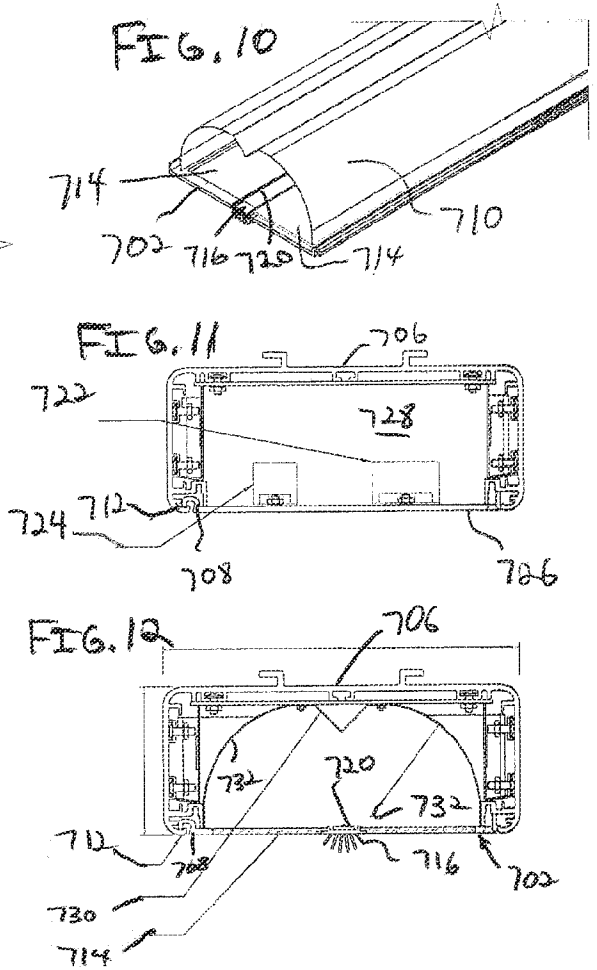
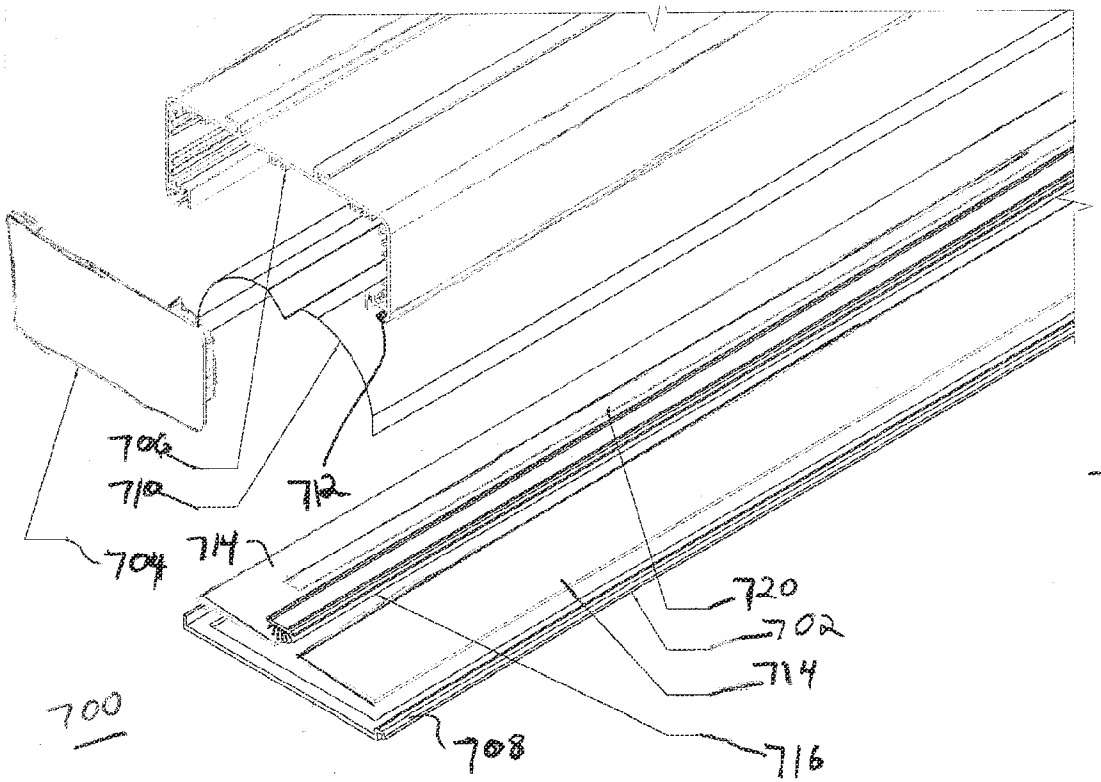
FIG. 9

LIGHTING DEVICES

RELATED APPLICATION DATA

This application is a Continuation application of co-pending U.S. patent application Ser. No. 13/627,411 filed on Sep. 26, 2012, incorporated herein by reference in its entirety.

BACKGROUND

Technical Field

The present invention relates to light fixtures, and more particularly to light emitting diode fixtures configured for easy maintenance and efficient use for retrofit in or replacement of fluorescent lights or fixtures.

Description of the Related Art

Existing linear fluorescent lighting fixtures utilize tube lamping in conjunction with a ballast and reflector to provide a lighting solution. Omnidirectional light output from a linear fluorescent light source is either directly or indirectly projected from the fixture in conjunction with some form of reflecting system or lens. Typical fluorescent tubes are terminated with either a single pin or multiple pins, which are fit into sockets which are wired to a ballast.

Typical useful life of fluorescent tube lamps is limited to 15,000 hours. Poor connections at the junction point of the lamp and socket results in premature lamp failure as well as a potential fire hazard due to arcing. Older magnetic ballasts contain hazardous PCBs and pose a disposal problem when replaced with newer solid-state ballasts. Common fluorescent light fixtures are not dimmable and perform poorly in cold temperature applications when not jacketed.

Fluorescent light tubes contain mercury and must be discarded using an environmentally sound method. Battery backed up fluorescent emergency lighting is complex (e.g., inverter type ballasts are required), is costly and provides a very limited operating time due to the high wattage needed. Fluorescent tubes are manufactured in various lengths and styles (T5, T8, T12, etc.), which provide a common average of 50-67 lumens per watt when powered with modern electronic ballasts.

A possible replacement/retrofit for linear fluorescent fixtures is to re-lamp a fluorescent fixture with LED tube lamps. LED tubes are self-contained light engines consisting of LED light sources, a solid-state driver, thermal management and lensing. These tubes are designed to fit the form factor of existing fluorescent tube styles and sizes (i.e., T5, T8, T12, etc.). LED tubes do not accept the voltage output of the existing fluorescent ballast. The tubes require the fixture to be re-wired, typically bypassing the ballast and supplying the retrofit tube with the mains voltage.

Due to limitations in their construction LED tubes have a limited light projection angle which under-utilizes the existing reflector and creates a narrower and distorted light distribution profile with shadows and hot spots. Heat from the LEDs is trapped in the sealed tube and is typically dissipated by an aluminum heat-sink on the top side of the tube itself. The limited heat dissipation of the tube heat sink typically shortens the product life of the LEDs and the encapsulated driver electronics. The wattage of the LED tube is practically limited by the ability to dissipate heat from the encapsulated light engine. The constant current/voltage integral driver encapsulated within the LED tube does not provide any means for dimming the light output. The reliability of the system is based on the socket to tube connection, which is subject to contamination and vibration.

Emergency battery backup operation is once again complex, costly and provides a very limited operating time due to the high wattage of the entire tube system.

SUMMARY

A lighting device includes a cover portion configured to have a hinged connection for mounting on a housing. The cover portion includes a light emitting diode (LED) and a mixing chamber having a reflective internal surface for receiving light from the LED. A phosphorescent lens is disposed opposite the LED and is configured to reflect light from the LED back to the mixing chamber and to emanate absorbed light from the lens to a surrounding region outside of the mixing chamber. An LED driver circuit is configured to power the LED, the LED driver circuit being electrically connected to a power source.

Another lighting device includes a cover portion configured to receive: at least one light emitting diode (LED), a reflector disposed opposite from the at least one LED and being configured to direct light received from the at least one LED to a surrounding region; and at least one lens mounted on the cover portion to permit reflected light to pass to the surrounding region. An LED driver circuit is configured to power the LED, the LED driver circuit being electrically connected to an alternating current or direct current power source.

A method for retrofitting a light emitting diode (LED) fixture in a fluorescent fixture, includes removing components, if needed, including bulbs from the fluorescent fixture; hingedly connecting a cover portion to a housing of the fluorescent fixture, the cover portion including an LED light assembly secured to the cover portion, the LED light assembly including a reflector, an LED board, a lens and an LED driver; connecting the LED light assembly to a power source; and securing the cover portion in a closed position using a locking mechanism.

The lighting devices provide energy saving linear LED light fixtures to replace fluorescent tube based fixtures with equal or superior light output and equal light distribution and extended lifetime.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein:

FIG. 9 is an exploded perspective view of a lighting device or fixture in accordance with another embodiment;

FIG. 10 is a perspective view of the device of FIG. 9 in an assembled configuration without a housing;

FIG. 11 is a view of the assembled device of FIG. 10 showing a driver compartment which may be disposed along a length of the device or at an end of the device in accordance with one embodiment;

FIG. 12 is cross-sectional view of the assembled device of FIG. 10 with a housing shown in accordance with the present principles.

DETAILED DESCRIPTION OF PREFERRED EMBODIMENTS

In accordance with the present principles, light fixtures are provided that overcome the deficiencies of the prior art. In one embodiment, a light emitting diode (LED) array is provided that can be retrofitted in an existing fluorescent lamp housing and can be wired directly to power leads or around existing ballast or sockets as needed. In another embodiment, the LED array is employed in a custom designed lamp. A linear non-tube LED based light fixture can replace or retrofit existing light fixtures and provide equal or better light performance, extended service life, greater reliability, significant energy savings and enhanced operating features (e.g., dimming, instant start, battery backup operation, etc.).

It is to be understood that the present invention will be described in terms of a given illustrative structure or architecture having illustrative circuit layouts; however, other architectures, structures, components and process features and steps may be varied within the scope of the present invention.

It will also be understood that when an element or component is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
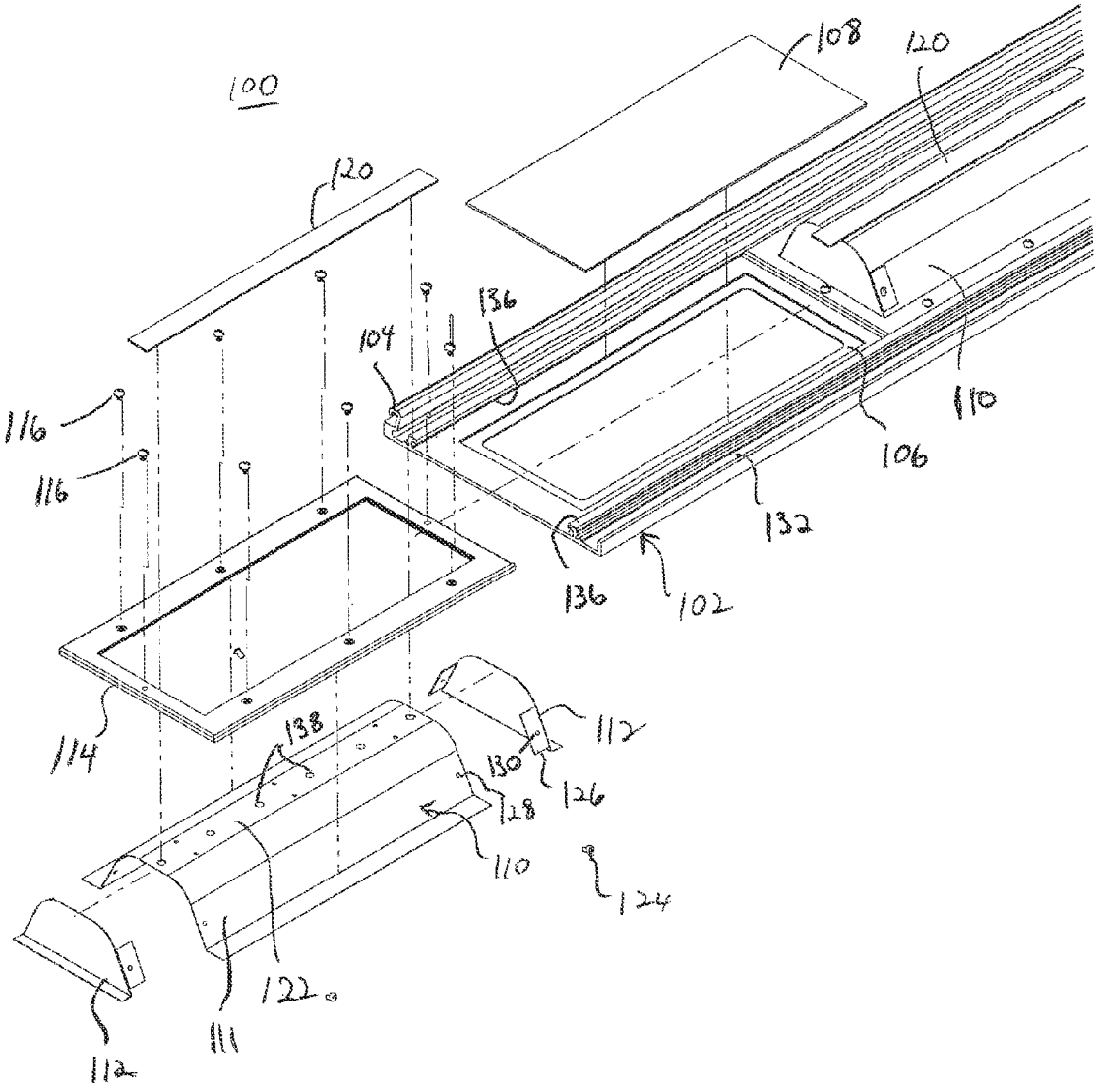
FIG. 1 is an exploded perspective view of a lighting device or fixture in accordance with one embodiment.

Referring now to the drawings in which like numerals represent the same or similar elements and initially to FIG. 1, a replaceable LED based light engine or fixture 100 is illustratively shown in an exploded view in accordance with one embodiment. Engine or fixture 100 includes a door or cover portion 102 which hingedly connects to a housing (not shown, e.g., a fluorescent fixture housing or a housing made for the present fixture) using a hinge portion or detail 104. Cover portion 102 easily opens relative to the housing or body of the light fixture for ease of service and rapid retrofitting. In this embodiment, the cover portion 102 includes an extruded two part detachable hinge detail 104. One side (104) of the hinge detail is part of the cover portion 102, and a mating part of the hinge is part of the fixture body or housing. The cover portion 102 secures to the housing body using quick release quarter turn captive screws (not shown), which would engage an area 132 of the cover portion 102. It should be understood that other arrangements may be employed to form a hinged connection, which may include, e.g., elements that employ a pivot pin or pins, or the hinge may be provided transversely to the longitudinal axis of the fixture, etc.

Cover portion 102 may include an extruded metal, polymer or other material. In one embodiment, the cover portion 102 includes extruded or cast aluminum. Cover portion 102 may be formed or machined to provide recesses 106 configured to receive a lens 108. In one embodiment, the lens 108 may include a phosphorescent material having light diffusing properties. The phosphorescent material absorbs LED light and re-emits the light. The LED light and the emitted light may include different wavelengths (i.e., colors). The lens 108 may be configured to enhance light effects or provide lighting effects consistent with a particular design. The recesses 106 receive mixing chamber(s) 110. The mixing chamber 110 includes a reflector 111 which receives end caps 112 to form a partial enclosure. The end caps 112 may include tabs 126 which may be secured to the reflector 111 by screws 124, rivets or other connecting mechanisms (e.g., clips, etc.).

The mixing chamber 110 fits within and extends through a tray 114. The tray 114 further supports the portions of the mixing chamber 110 and assists in its assembly. The tray 114 and the mixing chamber 110 may be secured using rails 136 on the cover portion 102. The tray 114 supports the pieces of the mixing chamber 110 and serves to secure the mixing chamber 110 and the lens 108 relative to the recess 106, which includes the lens 108. Once the tray 104 is assembled on the mixing chamber 110, the assembly may be slid along tracks or rails 136 to its assembled position corresponding with the recess 106. The tray 114 may be secured using screws 116 or other securing mechanism(s). All components are secured or fasten to the cover portion 102 to prevent any components or objects from falling out when the cover portion 102 is opened.

The mixing chamber 110 includes a flat portion 122 at its apex. The flat portion 122 includes openings 138 to receive or optically communicate with the LEDs (not shown) of an LED board 120. Light from the LEDs enters into the mixing chamber 112 and is reflected off of a plurality of surfaces in the mixing chamber 110. The mixing chamber 110 is shaped to diffuse light from the LEDs in a desired manner. The light from the LEDs is reflected off the lens 108 and internal surfaces of mixing chamber 110 to provide a soft illuminating light that is output at all angles (e.g., omnidirectional, i.e., 180 degrees including parallel or nearly parallel to the major surface of the cover portion 102).

It should be understood that the cover portion 102 may be adapted to fit with existing light fixtures and employ direct electrical connections with the existing electrical wiring. By adapting the hinge 104 to connect with existing fixtures, the cover portion 102 neatly covers the existing fixture and can be secured with clips or screws to maintain the cover portion 102 in its closed position. The cover portion 102 may be configured to accommodate any number of mixing chambers 110 and LED boards 120. For example, FIG. 1 shows an embodiment where the mixing chambers 110 are linearly disposed along a length of the cover portion 102. In other embodiments, the mixing chamber 110 may be disposed in a two-dimensional array in a same plane or have one or more mixing chambers 110 forming angles between one or more other mixing chambers 110. The angles may be longitudinal or lateral between the mixing chambers 110 and may be provided by the shape of the cover portion 102.

In one embodiment, the LED board 120 includes blue LED light sources, although any other colored LED sources may be employed. One embodiment provides a 300 mm linear strip arrangement of six royal blue LED's on 50 mm centers, such LED boards are available commercially. The present principles prefer to employ a large number of smaller LEDs to increase light output without generating large amounts of heat that would be provided by larger LEDs. The LED board 120 is bonded or connected to the exterior side of the apex 122 of the mixing chamber 110. This may include employing a thermally conductive ape strip, a thermally conductive adhesive or other thermally conductive attachment mechanism.

Figure 2:
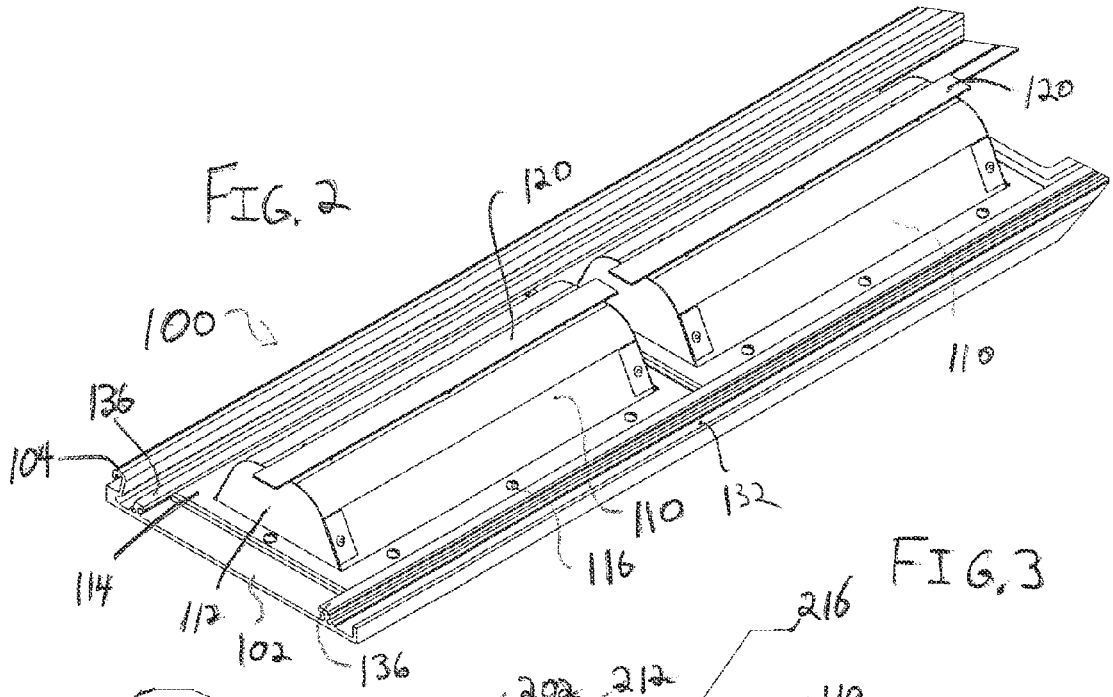
FIG. 2 is a perspective view of the device of FIG. 1 in an assembled configuration.

Referring to FIG. 2, an assembled kit is shown for fixture 100. The fixture 100 may be provided as a kit for replacing the fluorescent lights. By accommodating the hinged portion 104 and providing a locking mechanism opposite the hinge portion 104 (e.g., on portion 132), the fixture 100 can easily replace the internal components of the fluorescent fixture. FIG. 2 shows the assembled light fixture 100 with two mixing chambers 110 in view in accordance with one embodiment.

Figure 3:
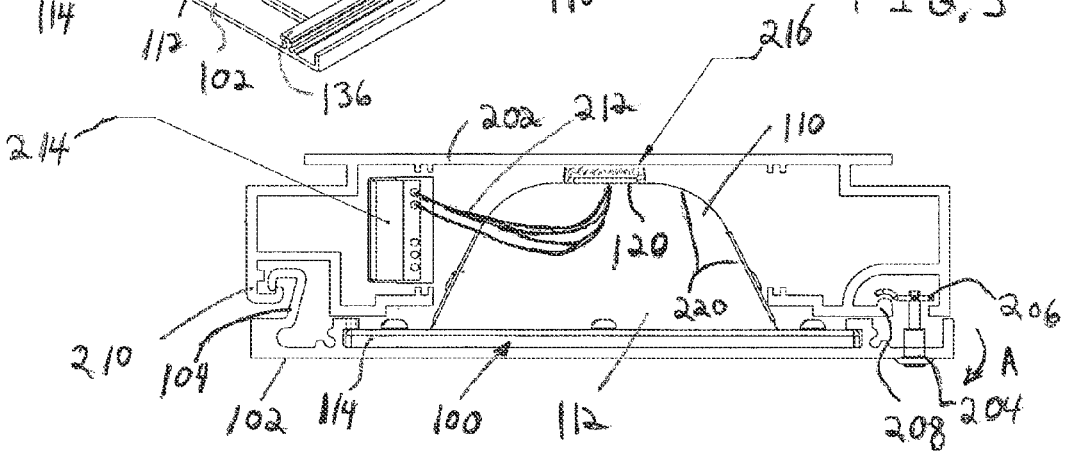
FIG. 3 is an end view of the assembled device of FIG. 2 in accordance with the present principles.

Referring to FIG. 3, an end view of the fixture 100 is shown mounted within a housing 202. The cover portion 102 is hingedly connected to the housing 202 using the hinge portion 104, which interfaces with a hinged connection 210 of the housing 202. When the cover portion 102 is closed, a fastener 204 is employed to turn a locking mechanism 206, which engages a portion 208 of the housing 202 to secure the cover portion 102 in the closed position. The fastener 204 and locking mechanism 206 are preferably permanently secured to the cover portion 102 to prevent parts from falling during maintenance, etc. By releasing the locking mechanism 206, the cover portion 102 opens in the direction of arrow "A" pivoting at the hinge 210. In this way, access to the LED boards 120, mixing chambers 110, etc. is provided for maintenance, replacement or other purposes.

In commercial or public environments, it is essential that fixtures disposed in high locations be easily accessible and maintained safely. Advantageously, the light fixture 100 is secured to the cover portion 102 such that no pieces of the light fixture 100 can fall out during maintenance or repair when the cover portion 102 is opened. In addition, the LED board 120 and an LED driver 214 are accessible and easily replaced/changed when the cover portion 102 is opened. This greatly reduces maintenance time and makes the process safer and more efficient.

Figure 5:
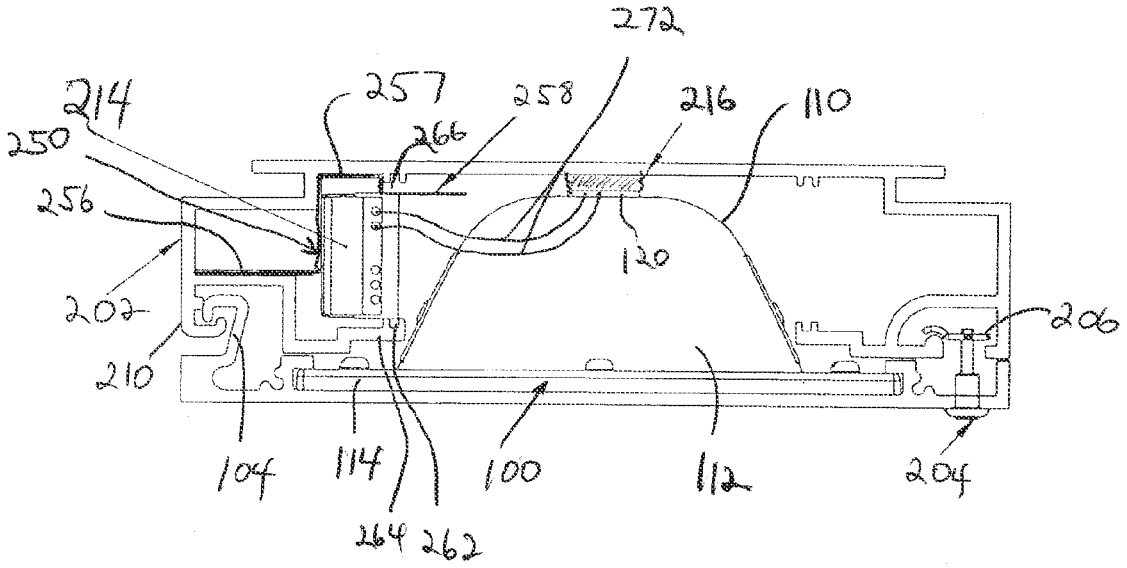
FIG. 5 is an end view of the assembled device of FIG. 2 showing the LED driver assembly of FIG. 4 installed therein in accordance with one embodiment.

A thermally conductive tape strip or adhesive 216 is employed to connect the LED board 120 with the housing 202 to permit the housing 202 to act as a heat sink. The thermally conductive tape strip 216 may include a thermally conductive gasket that is applied to thermal tape to provide contact to the housing 202. The housing 202 is preferably a conductive material and, in particular, may include aluminum. Contact with the aluminum of the housing 202, mixing chamber 110 and cover portion provides for thermal cooling of the LED boards 120 (and driver circuits (e.g., 214)). The LED driver 214 for the LED lights is preferably snap-in mounted to the housing 202 to provide proper thermal management utilizing the entire housing 202 of the fixture as a heat sink. A tool-less spring bracket is shown in FIG. 5 and provides rapid installation and replacement of the LED driver 214 and other components.

Holes 138 (FIG. 1) in the upper side of the mixing chamber 110 provide access for the LED light to enter the cavity of the mixing chamber 110. In this embodiment, a shape of the mixing chamber is optimized to provide uniform light distribution to exit window or lens 108 (FIG. 1). The lens 108 may include phosphorous material to enhance light illumination, color and distribution. Interior surfaces 220 of the mixing chamber 110 are coated or formed of reflective material, which optimizes light reflected back into the chamber from the inside of the lens 108.

Referring again to FIG. 1 with continued reference to FIG. 3, in one embodiment, the cover portion 102 includes phosphorous panels for lenses 108. The phosphorous panels convert internal blue light from the LED boards 120 to white light, which is emitted as the exit light source from the fixture 100. The remote phosphor panels 108 are sealed and bonded to the cover portion 102 to provide a watertight and dust-tight barrier. The phosphor panels 108 diffuse light in a truly Lambertian pattern. Secondary optics can also be mounted to the exterior of the cover portion 102 to provide alternative light distribution profiles.

Figure 4:
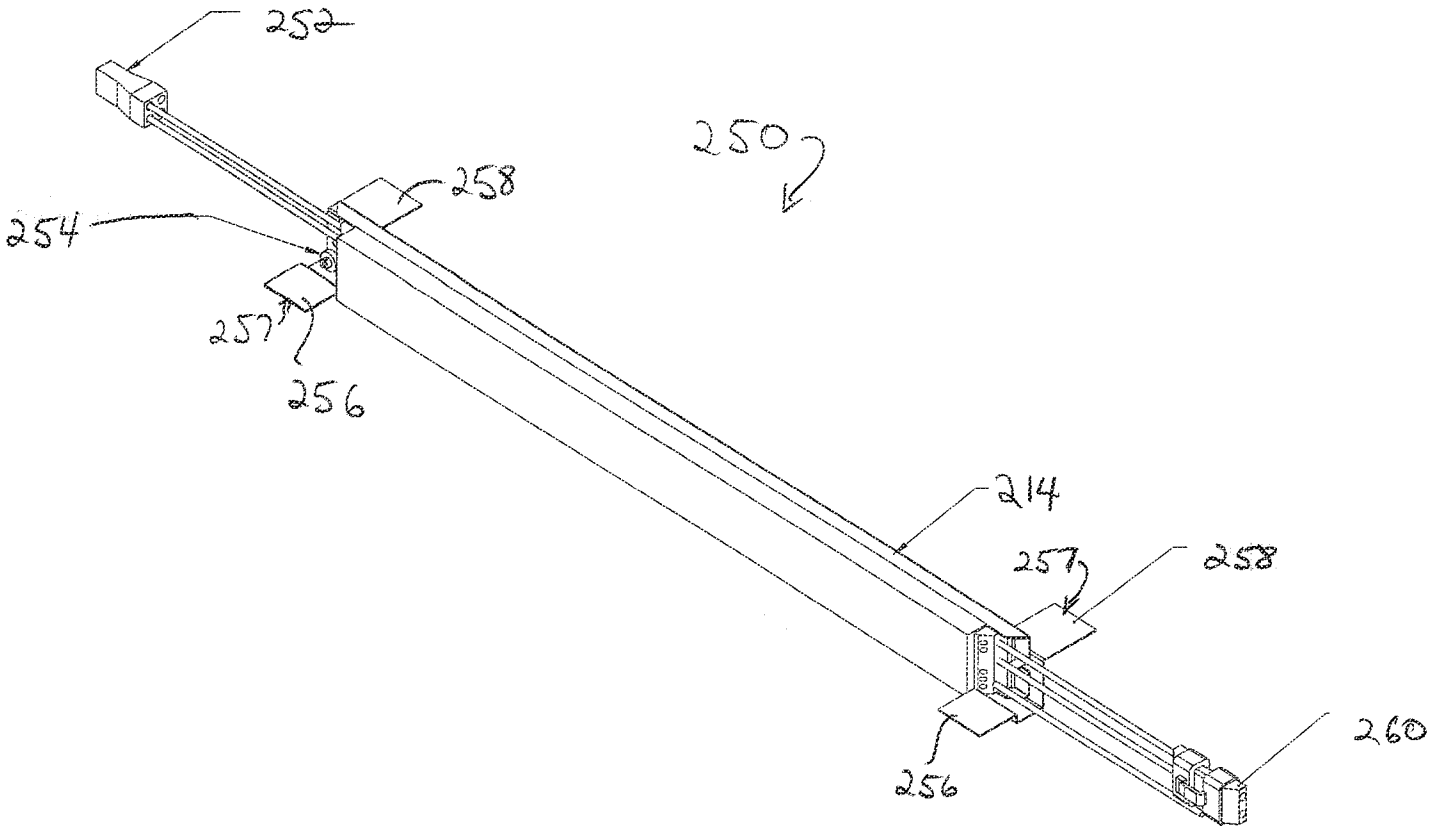
FIG. 4 is a perspective view of an LED driver assembly configured with spring brackets for quick installation and replacement in accordance with one embodiment.

Referring to FIG. 4, an LED device driver assembly 250 is shown in accordance with one embodiment. Assembly 250 includes the device driver 214, which may be enveloped in a metal case or housing in some embodiments. Spring brackets 257 are provided on the assembly 250 and provide the snap-in spring bias for easily installing the device driver assembly 250 into the housing 202. Each bracket 257 preferably includes a conductive material with high elasticity. The brackets 257 may be integrated into a housing that surrounds the driver device 214 with conductive material (metal) to further enhance thermal management. Each bracket 257 includes securing tabs or clips 256 and 258 to provide tool-less mounting in the housing 202. The driver device 214 includes a quick connect input connector 252 and a quick connect output connector 260 for making easy electrical connections. A dimmer circuit 254 may be provided on the assembly 250 and may be manually or automatically adjusted. A similar assembly may be provided for other components as well, e.g., the emergency driver, etc.

Referring to FIG. 5, an end view of the fixture 100 is shown mounted within the housing 202. The cover portion 102 is hingedly connected to the housing 202 using the hinge portion 104, which interfaces with the hinged connection 210 of the housing 202. The LED driver assembly 250 is shown mounted in a region of the housing adapted to receive the driver assembly 250. The brackets 257 are deflected to bias the driver device 214 against a structure 264. A wall 262 or other holding mechanism provides support and a conductive path for thermal management. The brackets 256 also provide thermal paths to the housing 202 or air spaces in the housing for thermal management. When the driver device 214 needs to be replaced an operator simply pulls down on clip 258 and the bracket 257 is released as against a surface 266 (wall 262 can rotate forward and may remain secure in the housing 202). The driver device assembly 250 or driver device 214 can be replaced without tools, and quick connectors 252, 260 connect with mating connectors directly to LED wires 272 for LED board 120 and power wires (not shown).

Figure 6:
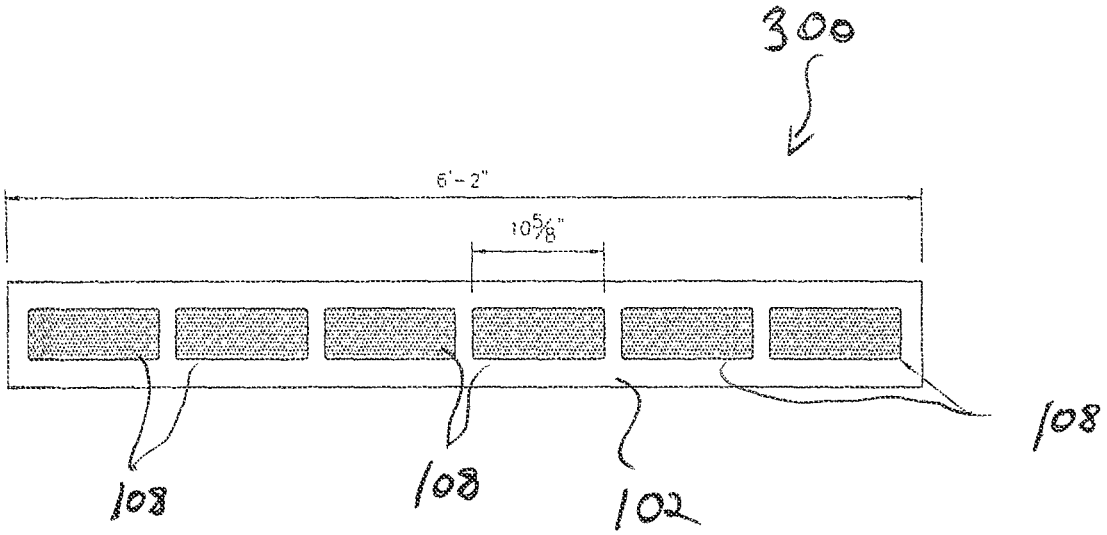
FIG. 6 is a bottom view of the lighting device of FIG. 2 showing an appearance of the lighting device with six lighting assemblies in accordance with one embodiment.

As described above, multiple light engines including LED boards 120 can be cascaded or otherwise arranged in arrays to provide varying width/length and hence varying lumen output light sources. Referring to FIG. 6, a fixture 300 shows the cover portion 102 having six tenses 108 in accordance with one embodiment. In this embodiment, a length of the overall fixture is 6 feet 2 includes which is a standard size for fluorescent lighting fixtures. The six lenses 108 are evenly spaced along the length and may measure about 10 and ⅝ inches in length. Note that these dimensions are illustrative and other dimensions and arrangements may be employed as well.

Figure 7:
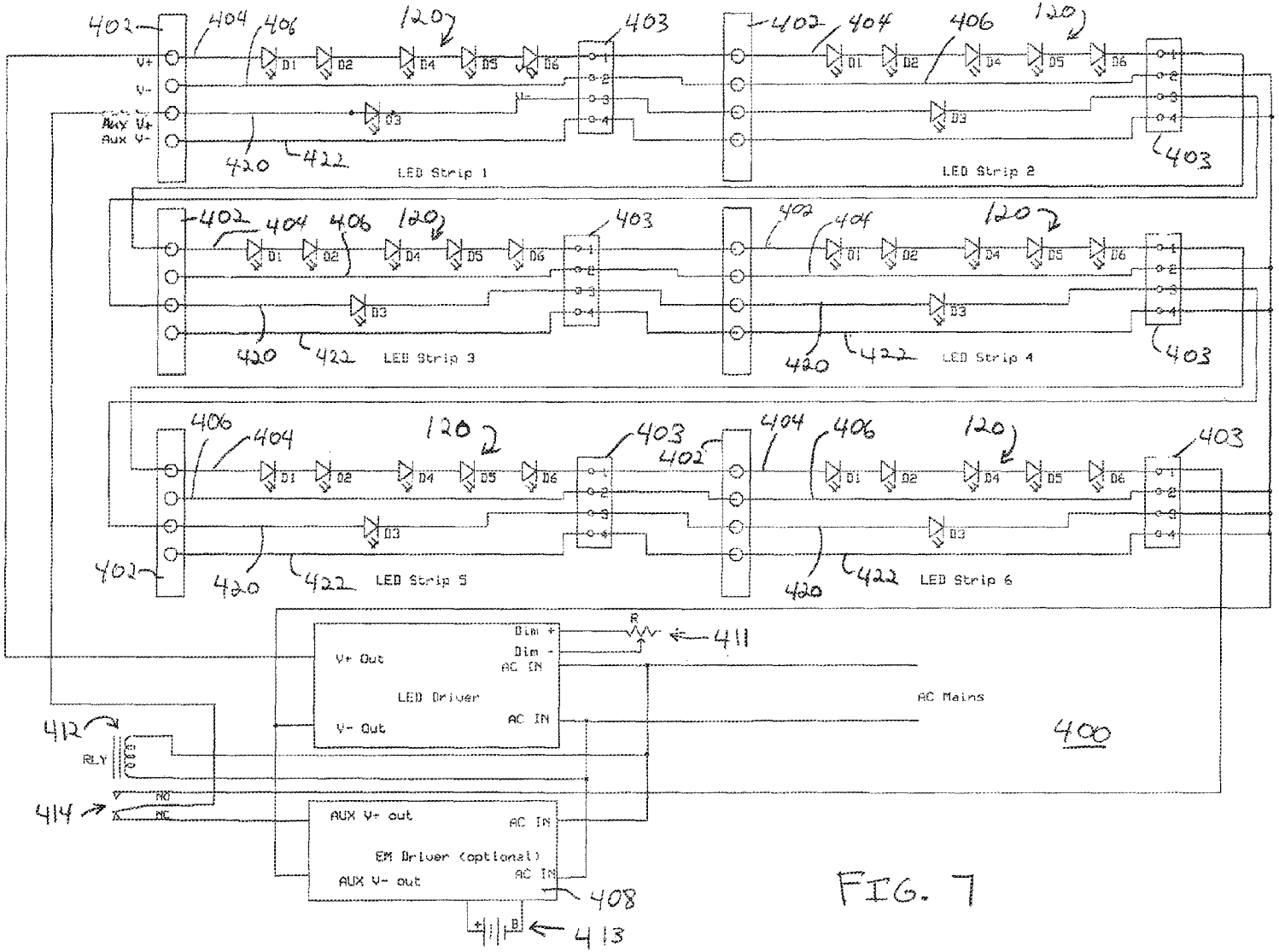
FIG. 7 is a schematic diagram showing wiring of LEDs in accordance with one embodiment.

Referring to FIG. 7, a schematic diagram illustratively shows a circuit 400 for wiring the configuration shown in FIG. 6 (six light panels/sources (108)). In this embodiment, the LED driver 214 is connected to AC mains through AC inputs (AC IN) to receive and distribute power to six LED boards or strips 120. DC power of appropriate voltage may be provided directly to the LED boards, if needed or desired. Each board 120 corresponds to a lens 108 in FIG. 6. A V+ output from the driver 214 connects to an input block 402 of the LED strip 1 (120). LEDs D1, D2, D4, D5 and D6 are connected in series on a first line 404 between the input blocks 402 and output blocks 403 for all six strips 120. The LED driver 410 may be plugged into the LED light sources (strips 120) with positive locking quick disconnect connectors (252, 260 in FIG. 4).

A second line 406 is connected to a V− output of the driver 214. A third line 420 connects to an auxiliary (Aux) V+ output of an optional emergency LED driver 408, and a fourth line 422 connects to an Aux V− output of the emergency LED driver 408. The emergency LED driver 408 also serves as a charger for a reserve battery pack 413. The battery 413 provides power to the driver and hence the LEDs during emergency operation. The battery 413 may be located within the light fixture 100, although it may be remotely disposed from the fixture as well.

The third line 420 includes an LED D3. During an emergency, auxiliary power may be needed to provide light. A relay 412 is sensitive to normal line voltage and is active when incoming voltage is sensed. When active, the relay 412 selects the driver 214 and circuits 404 and 420 powering the entire LED array. During an outage, relay 412 deactivates and selects the alternative emergency driver 408 (in this case battery operated) and emergency LED array string 420 only. This powers the LED D3 in all of the strips 120. The emergency driver 408 provides power to the limited number of LEDs (D3) to provide the emergency lighting. Multiple light string circuits are utilized to provide for diminished light output when battery backup emergency lighting is needed.

The driver 214 may include a dimmer circuit 410 (254, FIG. 4) configured to dim the LEDs D1, D2, D4, D5 and D6 as needed or desired using, e.g., a variable resistance 411. It should be understood that various lighting effects may be provided using the dimmable LED driver 214. The continuously variable dimming function provides the ability to program numerous light levels both remotely and from within the fixture. This function allows a single LED fixture to replace or retrofit multiple fixture types of varying wattages. Such effects may include flashing the LEDs, changing colors or intensities of the LEDs in one or more sequences, etc.

As mentioned, the driver 214 and/or the driver 408 for the LED light engines is/are mounted to the fixture body to provide thermal management utilizing the entire housing 202 of the fixture as a heat sink.

Figure 8:
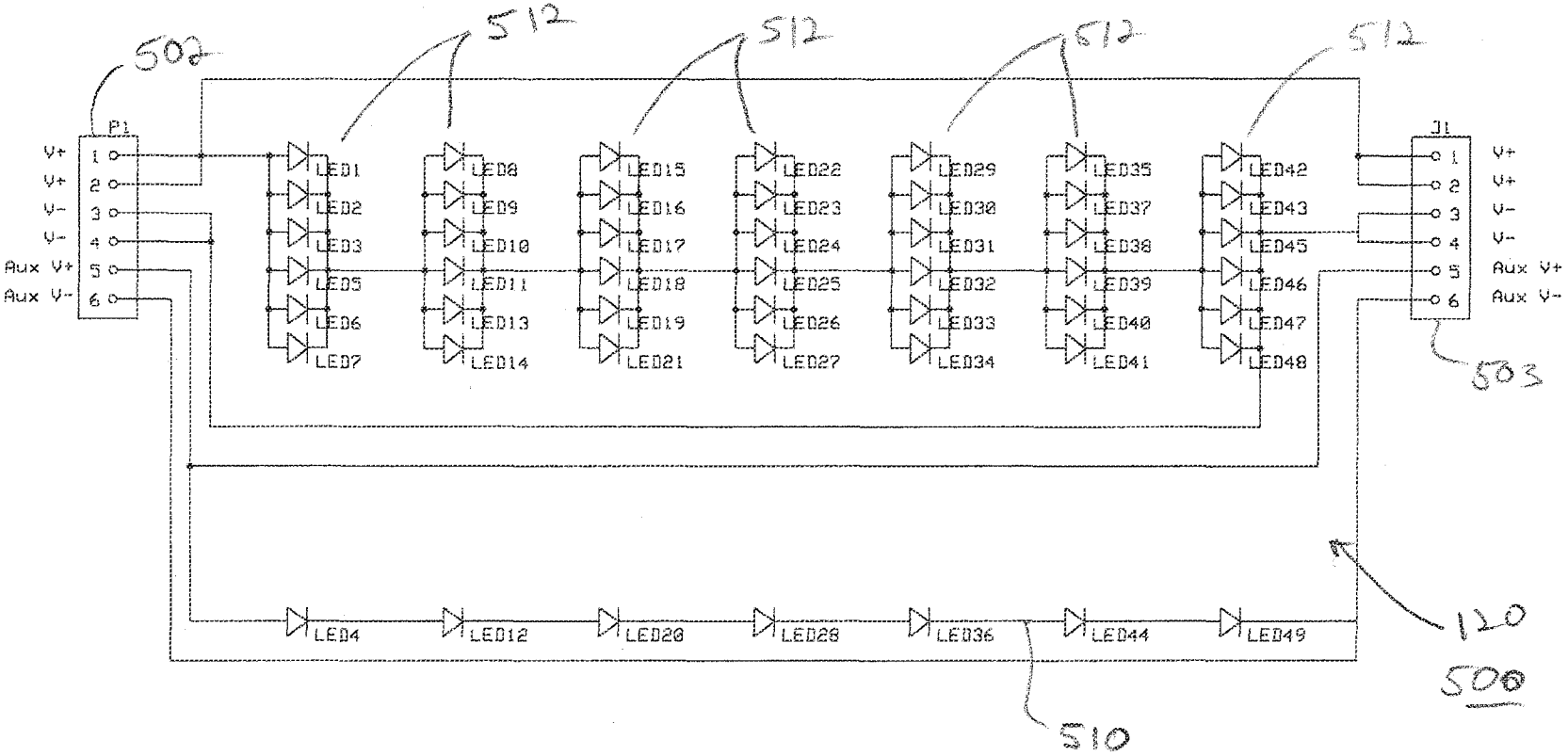
FIG. 8 is a schematic diagram showing wiring of LEDs in accordance with another embodiment.

Referring to FIG. 8, another schematic diagram illustratively shows a circuit 500 for wiring a single panel (108). The board 120 includes LEDs, LED1-LED49, which form an array of light sources. The board 120 is connected between an input block 502 and an output block 503. In this example, pins 1 and 2 of the input block 502 and the output block 503 are employed for V+ and, as such, are connected to each other. Pins 3 and 4 of the input block 502 and the output block 503 are employed for V− and are also connected to each other. Pins 1 and 2 of the input block 502 and the output block 503 are employed for Aux V+ and Aux V−, respectively, for use with an optional emergency lighting system. The board 120 may be connected to other boards as described and shown in FIG. 7. In this embodiment, the board 120 includes seven groups 512 of LEDs, which are connected in parallel in each group 512. The groups 512 are connected in series across the input block 502 and the output block 503. A string of LEDs are connected in series to provide an alternate emergency lighting path. The emergency lights include LEDs: LED4, LED12, LED20, LED28, LED36, LED44 and LED49 in this example. It should be understood that other configurations are also contemplated.

Referring to FIG. 9, another embodiment is shown which includes the "door" based strategy for a cover portion 702 of a fixture 700. In this embodiment, all the light emitted from an LED board 720 is reflected by a reflector 710 as opposed to the embodiment of FIG. 1, which employed LED light as well as reflected light through a diffusion panel. The reflector 710 and the LED board 720 may extend an entire length of the fixture 700 or be broken up into smaller sections as desired.

The cover portion 702 may be considered a door, and may be formed from extruded aluminum (or other materials, preferably conductive materials). The cover portion 702 and a housing 706 include a two part detachable hinge detail, as before. A portion 708 of the hinge detail is part of the cover portion 702, and a mating part 712 of the hinge detail is part of the fixture body or housing 706. The cover portion 702 is secured to the housing 706 using a quick release quarter turn captive screw(s) similar to that depicted in FIG. 3. An extruded heat sink 716 may include aluminum or other suitable material and is mounted on a center portion of the cover portion 702. The heat sink 716 may include radiating fins facing away from an exterior face of the cover portion 702. A linear LED strip or strips 720 are mounted to the inside of the heat sink 716 and secured with a layer of thermal compound or other thermally conducting interface, which is to be disposed between a metal core printed wiring board (720) that includes the LEDs and an inside surface of the heat sink 716. Once the cover portion 702 is secured to the fixture body or housing 706, the entire structure (e.g., housing 706 and cover portion 702) becomes a massive heat sink.

The LED board or boards 720 mounted to the heat sink 716 are positioned in a linear fashion and are pointed towards the inside of the fixture. Multiple light strips can be cascaded to provide varying length and hence varying lumen output fixtures. Multiple light string circuits are utilized to provide for diminished tight when battery backup emergency lighting is needed. Examples of such circuits are illustratively shown in FIGS. 7 and 8.

The reflector 710 is mounted to the inside of the cover portion 702 and is shaped to provide a desired light distribution profile and light diffusion. In this embodiment, the reflector may be fabricated with 98% or more reflective white optics material, although other reflective surfaces and effects may be employed. The reflector 710 includes a "V" shaped portion 730 that reflects LED light laterally into arcuate portions 732 (see FIG. 12). In one embodiment, clear windows or lenses 714 are employed on the cover portion 702. The lenses 714 may be formed from polycarbonate, glass or other translucent materials. The tenses 714 are sealed on the cover portion 702 to prevent contaminants from entering the light cavity.

End plates 704 are secured on end portions of the housing 706 and may include reflective materials. FIG. 10 shows a reflector assembly outside the housing 706. Note that the heat sink 716 and the LED board 720 bisects the tenses 714. It should be understood that the heat sink 716 and the LED board 720 may be placed at other locations on the cover portion 702 and that the reflector may include other shapes to accommodate these other locations. Secondary optics can also be mounted to the exterior of the cover portion 702 to provide alternative tight distribution profiles.

Referring to FIG. 11, a cross-sectional view of the fixture 700 is shown. A separate compartment 728 may be employed to house a dimmable LED driver 724 and an emergency power module or driver 722. The drivers 722 and 724 may be mounted on a separate door 726 on the fixture 700 to permit easy access to the drivers 722 and 724 for maintenance or other purposes. The door 726 may employ the same hinge detail (712 and 708) as described above. The tool-less mounting of the drivers 722 and 724 may be implemented as described above.

Referring to FIG. 12, another cross-sectional view of the fixture 700 is depicted showing a shape of the reflector 710. Due to the direct beam typical for LEDs, the reflector 710 in accordance with one embodiment includes an angled portion or "V" portion 730 to direct the LED light laterally into arcuate sections 732. In this embodiment, all of the LED light is directed away from the location where the light is needed and hence all of the light passing through lenses 714 has been reflected.

The embodiments described with respect to FIG. 1 and FIG. 9 can provide greater reliability by eliminating fluorescent lighting solutions. In a retro-fit scenario, the connectors may be employed to make direct connections for the LED boards. In addition to longer lasting light sources and increased reliability, light output for a 6 foot fixture in accordance with the present principles was compared to that of a two lamp T8 fluorescent of the same size. The present embodiments provided better performance than that of fluorescent fixture with an energy savings of 33% or more. Some of the many advantages also include safe and rapid lamping replacement using the hinged door design. In addition, bulbs including mercury or other toxins need not be employed, and the useful lifetimes of LEDs can far exceed the useful lifetimes of fluorescent bulbs. For example, LEDs can last for 50,000 hours or more.

Illustrative lumen calculations using Samsung® 2323 LEDs include the following (in FIG. 9 design): $I_f$=65 mA/LED; $V_f$=3.00 V/LED; $^{\Phi}v$=281 m/LED @ 65 mA. Power Dissipation for 6 fixture=57.33 watts. Lumens for 6 ft. Fixture=8232 lumens. Lumens/Watt for 6 ft. fixture=(8232 lumens}57.33 watts=143.58 lumens/watt.

Illustrative lumen calculations using Phillips® Luxeon Royal Blue LEDs include the following (in FIG. 1 design): $I_f$=700 mA/LED; $V_f$=3.00 V/LED; Phosphor Conversion Efficacy at 4000K=210 lm/Wrad. Radiometric Power for 6 foot fixture=40.32 rad watts. Lumens for 6 ft. fixture=8467.2 lumens. Power Dissipation for 6 ft. fixture=75.6 watts. Lumens/watt for 6 ft. fixture=112 lumens/watt. The performance of the devices in accordance with the present principles far exceeds that output of conventional fluorescents fixtures. In addition to great reductions in maintenance time, increased safety for overhead replacements and superior tight output, the increased useful life of LED fixtures can result in significant cost and time savings.

Figure 13:
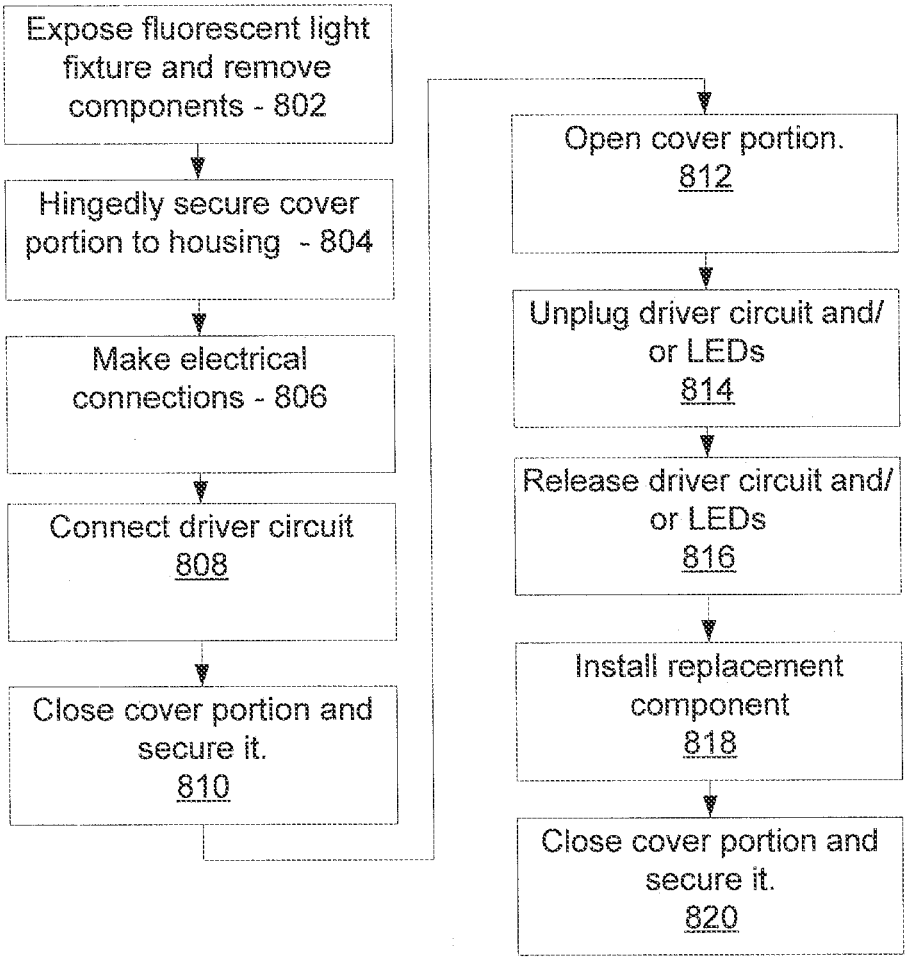
FIG. 13 is a blockflow diagram showing a method for retrofitting and maintaining a fluorescent fixture with a cover portion and tight assembly in accordance with the present principles.

Referring to FIG. 13, a method for retrofitting and maintaining an LED light assembly, in accordance with the present principles, in a fluorescent fixture is illustratively described. In block 802, a fluorescent fixture or housing is configured to receive an LED light assembly in accordance with the present principles. This may include exposing the light fixture (covers removed, etc.) and, removing fluorescent bulbs, if needed. Components such as bulbs need to be removed, other components can remain if clearance exists for the new fixture. In block 804, a cover portion in accordance with the present principles is hingedly secured to the housing, or a hinged connection is created by creating a detail 210 (or equivalent) in the housing. The cover portion includes LEDs, mixing chambers/reflectors, drivers and other components secured on the cover portion. In block 806, electrical connections are made. This may include stripping back electrical leads and installing quick connectors. In block 808, make connections with the driver circuit. In block 810, close the cover portion and secure it with a locking mechanism. The light is now ready for use. To maintain or replace components, the cover portion is opened by releasing the locking mechanism in block 812. In block 814, electrically unplug the driver circuit or the LED board or both. In block 816, unsnap or release the driver circuit or the LED board from the cover portion. In block 818, install a replacement component by snapping in a new driver, new LED circuit, etc. In block 820, re-secure the cover portion sing the locking mechanism.

Having described preferred embodiments for improved lighting devices (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A lighting device, comprising:

a hinged portion configured to be hingedly connected to a mount, the hinged portion including:

at least one light emitting diode (LED);

a mixing chamber having a reflective internal surface for receiving and reflecting light from the at least one LED; and a lens disposed opposite the at least one LED and configured to reflect light from the at least one LED back to the mixing chamber and to emanate absorbed light from the lens to a surrounding region outside of the mixing chamber; and an LED driver circuit configured to power the at least one LED, the LED driver circuit being electrically connected to a power source;

wherein the hinged portion includes rails which slidably receive portions of a light assembly including the at least one LED to permit mounting of the light assembly on the hinged portion.

2. The lighting device as recited in claim 1, further comprising a locking mechanism to secure the hinged portion.

3. The lighting device as recited in claim 1, wherein the LED driver circuit includes brackets configured to mount the LED driver circuit without using tools.

4. The lighting device as recited in claim 3, wherein the brackets are spring loaded.

5. The lighting device as recited in claim 1, further comprising a plurality of lighting assemblies mounted on the hinged portion.

6. The lighting device as recited in claim 1, wherein the mixing chamber includes a reflector portion having an apex that runs parallel to a longitudinal axis of the lighting device, and the at least one LED being in optical communication with the reflective internal surface through openings at the apex.

7. The lighting device as recited in claim 6, wherein the mixing chamber includes reflective end plates transversely disposed to the apex on end portions of the reflector portion.

8. The lighting device as recited in claim 1, wherein the mixing chamber includes a conductive material and functions as a heat sink for the at least one LED.

9. The lighting device as recited in claim 1, wherein the at least one LED includes at least one emergency LED activated by an emergency circuit during a power outage.

10. A lighting device, comprising:

a hinged portion configured to be hingedly connected to a mount, the hinged portion including:

a hinge to open the hinged structure; and a lighting assembly, including:

at least one light emitting diode (LED);

a mixing chamber having a reflective internal surface for receiving and reflecting light from the at least one LED; and a lens disposed opposite the at least one LED and configured to reflect light from the at least one LED back to the mixing chamber and to emanate absorbed light from the lens to a surrounding region outside of the mixing chamber;

wherein the hinged portion includes rails which slidably receive portions of the light assembly to permit mounting of the light assembly on the hinged portion.

11. The lighting device as recited in claim 10, further comprising a locking mechanism to secure the lighting assembly.

12. The lighting device as recited in claim 10, further comprising an LED driver circuit configured to power the at least one LED, the LED driver circuit being electrically connected to a power source.

13. The lighting device as recited in claim 12, wherein the LED driver circuit includes brackets.

14. The lighting device as recited in claim 13, wherein the brackets are spring loaded.

15. The lighting device as recited in claim 10, wherein the mixing chamber includes a reflector portion having an apex that runs parallel to a longitudinal axis of the lighting device, and the at least one LED being in optical communication with the reflective internal surface through openings at the apex.

16. The lighting device as recited in claim 10, wherein the hinge is configured to permit access to the lighting assembly without using tools.

17. The lighting device as recited in claim 10, wherein the mixing chamber includes a conductive material and functions as a heat sink for the at least one LED.

18. The lighting device as recited in claim 10, wherein the at least one LED includes at least one emergency LED activated by an emergency circuit during a power outage.

19. A lighting device, comprising:

a hinged portion configured to be hingedly connected to a mount, the hinged portion including:

at least one light emitting diode (LED);

a mixing chamber having a reflective internal surface for receiving and reflecting light from the at least one LED, wherein the mixing chamber includes a reflector portion having an apex that runs parallel to a longitudinal axis of the lighting device, and the at least one LED being in optical communication with the reflective internal surface through openings at the apex; and a lens disposed opposite the at least one LED and configured to reflect light from the at least one LED back to the mixing chamber and to emanate absorbed light from the lens to a surrounding region outside of the mixing chamber; and an LED driver circuit configured to power the at least one LED, the LED driver circuit being electrically connected to a power source.

20. The lighting device as recited in claim 19, wherein the hinged portion includes rails which slidably receive portions of a light assembly including the at least one LED to permit mounting of the light assembly on the hinged portion.

21. A lighting device, comprising:

a hinged portion configured to be hingedly connected to a mount, the hinged portion including:

a hinge to open the hinged structure; and a lighting assembly, including:

at least one light emitting diode (LED);

a mixing chamber having a reflective internal surface for receiving and reflecting light from the at least one LED, wherein the mixing chamber includes a reflector portion having an apex that runs parallel to a longitudinal axis of the lighting device, and the at least one LED being in optical communication with the reflective internal surface through openings at the apex; and a lens disposed opposite the at least one LED and configured to reflect light from the at least one LED back to the mixing chamber and to emanate absorbed light from the lens to a surrounding region outside of the mixing chamber.

22. The lighting device as recited in claim 20, wherein the hinged portion includes rails which slidably receive portions of a light assembly including the at least one LED to permit mounting of the light assembly on the hinged portion.

* * * * *